US010021983B2

(12) United States Patent
Mark

(10) Patent No.: US 10,021,983 B2
(45) Date of Patent: Jul. 17, 2018

(54) ERGONOMIC CHAIR

(71) Applicant: Darren William Mark, Brattleboro, VT (US)

(72) Inventor: Darren William Mark, Brattleboro, VT (US)

( * ) Notice: Subject to any disclaimer, the term of this patent is extended or adjusted under 35 U.S.C. 154(b) by 74 days.

(21) Appl. No.: 15/159,880

(22) Filed: May 20, 2016

(65) Prior Publication Data

US 2016/0345741 A1 Dec. 1, 2016

Related U.S. Application Data

(60) Provisional application No. 62/166,524, filed on May 26, 2015.

(51) Int. Cl.

| | |
|---|---|
| ***A47C 7/02*** | (2006.01) |
| ***A47C 7/00*** | (2006.01) |
| ***A47C 7/40*** | (2006.01) |
| ***A47C 3/18*** | (2006.01) |
| ***A47C 3/025*** | (2006.01) |
| ***A47C 9/00*** | (2006.01) |

(52) U.S. Cl.

CPC ..... *A47C 7/002* (2013.01); *A47C 3/0252* (2013.01); *A47C 3/18* (2013.01); *A47C 7/40* (2013.01); *A47C 7/402* (2013.01); *A47C 9/005* (2013.01)

(58) Field of Classification Search

CPC ..... A47C 4/45; A47C 9/002; A47C 3/0252; A47C 9/005; A47C 3/18; A47C 7/402; A47C 7/40; A47C 7/002; A63B 41/00; A63B 21/0414; A63B 2208/0233; A63B 2225/62; A63B 21/045

USPC ..... 297/452.41, 440.22, 195.11, 217.7, 480, 297/199, 284.1, 284.2; 446/220, 223, 446/226; 5/654, 655.3

See application file for complete search history.

(56) References Cited

U.S. PATENT DOCUMENTS

| | | | | |
|---|---|---|---|---|
| 2,999,688 | A * | 9/1961 | Gabrielson | A63G 13/08 472/135 |
| 5,690,389 | A | 11/1997 | Ekman | |
| 6,070,973 | A * | 6/2000 | Sachs | B41J 2/025 347/75 |
| 7,588,522 | B2 * | 9/2009 | Heitzman | A47C 4/54 297/195.11 |
| 8,056,976 | B1 | 11/2011 | Polk | |
| 8,919,881 | B2 * | 12/2014 | Bay | A47C 7/402 297/311 |
| 9,415,276 | B1 * | 8/2016 | Hao | A63B 41/00 |
| 9,655,455 | B2 * | 5/2017 | Barnett | A47C 4/54 |
| 2004/0256532 | A1 * | 12/2004 | Liao | A47C 3/16 248/346.01 |
| 2006/0080781 | A1 * | 4/2006 | Zheng | A47C 4/54 5/681 |

(Continued)

*Primary Examiner* — Chi Q Nguyen

(74) *Attorney, Agent, or Firm* — Lambert & Associates; Gary E. Lambert; David J. Connaughton, Jr.

(57) ABSTRACT

A chair having a contoured seat cushion mounted on top of an exercise ball with four tension-adjustable elastic cords such as bungee cords is provided. The shock absorbing cords may attach to the underside of the seat cushion by looping through spring-eye carabiner type hooks, and may pass through grooved locking tubes with v-channels for adjusting the cord tension. The ball may sit on top of a swivel plate, so that dynamic motion and counterbalancing are attainable for a variety of ergonomically beneficial seating styles.

19 Claims, 4 Drawing Sheets

(56) References Cited

U.S. PATENT DOCUMENTS

| | | | | |
|---|---|---|---|---|
| 2007/0290535 | A1* | 12/2007 | Meredith | B60N 2/42736 297/217.1 |
| 2008/0176727 | A1* | 7/2008 | Heitzman | A47C 4/54 482/142 |
| 2012/0082748 | A1* | 4/2012 | Chen | A63B 41/00 425/536 |
| 2013/0140861 | A1* | 6/2013 | Chen | F41B 3/02 297/217.1 |
| 2013/0154333 | A1* | 6/2013 | Wu | A47C 4/03 297/452.23 |

* cited by examiner

ERGONOMIC CHAIR

FIELD OF THE INVENTION

The present invention pertains to chairs and stools, and more particularly, to ergonomic chairs, providing comfortable seating that not only alleviates back problems but encourages core strengthening, blood circulation, muscular involvement, for overall back, muscular and circulatory health.

BACKGROUND

There are a myriad of chair designs extant, many of which claim to be more efficient, more comfortable, or more therapeutic than others. Most recently exercise balls have been used, either alone or within a chair "frame" for core strengthening but are problematic because when used alone they roll away, deflate, don't provide enough stability, and most significantly, don't provide appropriate weight distribution on the coccyx, femurs, gluteal region, and through recent studies, have been found that they do not engage the core muscles more than a traditional chair.

Prior to the ball chairs, foam, rubber and mesh materials have been used in chair manufacture, so as to provide soft, flexible surfaces. Foam and rubber surfaces lend support, while also providing comfort. Foam materials can be designed to provide either stiff or soft support. Strategic placement of stiffening materials within soft foam or rubber shells have been found useful in delivering sustained back comfort over extended periods of time for individuals having normal spine alignments. However, a great number of people have moderate-to-severe back problems.

The primary problem with all existing chair forms, is that the seating platform, whether an inflatable ball, fixed, or otherwise 'ergonomic' is fixed in one plane, so that the angle of the spine, legs and hips, are captive for long periods of sitting, with no ability to change the sitting position, creating constant compressive force on the vertebrae, causing pain to the lower back, limiting circulation and virtually eliminating active muscle engagement.

In U.S. Pat. No. 5,690,389 A the invention entitled "Pneumatic, ball-shaped chair" is discussed. Features of the aforementioned chair include a chair having a large, inflated, ball-shaped seat. The ball-shaped seat of the chair re-forms in response to an individual's weight and his or her seated position.

The present invention differs from the ball-shaped chair of the aforementioned patent in that the current invention in substantial ways. The present invention captures the benefits of the previous invention but solves several problems, namely: the angle of the sitter can change dynamically throughout the day; the bungee cords offer resistance and encourage active sitting as opposed to passive balancing; the contoured seat distributes the sitters weight appropriately and thus avoids leg and gluteal discomfort; the swivel plate allows for side to side twisting and torsioning; and the balance of the top plane allows for front to back and side to side movement but held within a harmonically balanced yet adjustable relationship with the sitter, ball, chair and floor. The harmonic balance that the seat is held in, allows the sitter to do abdominal exercises suitable to their fitness level while sitting. Further, the invention has a spring-loaded articulated back support to not just passively provide lumbar support but actively engage the lower back to both encourage movement and continually correct the sitter's posture.

Therefore what is needed is a chair or stool that facilitates dynamic motion, encourages movement, enables an almost constant weight and angle shifting as well as balancing and rebalancing, while engaging the gluteal, leg, ab, and lower back muscles.

SUMMARY OF THE INVENTION

The present invention includes an ergonomic chair that improves strength, endurance, and flexibility of the user while improving circulation and reducing fatigue and back pain. The present invention is useful for people who sit for an extended period of time at work and minimizes workstation related back pain and neck pain. The present invention incorporates an exercise ball at its core, counter-tensioned in harmonic balance by adjustable elastic cords and features a contoured seat cushion for proper weight distribution. The balanced nature of the seat cushion enables the user to adjust the pitch and angle of the legs, hips, and spine, eliminating the stiffness associated with being stuck in a static seated position for long periods. The present invention further incorporates an articulated back support that is adjustable and removable, and a back cushion that is loaded with spring coils for lumbar support and resistance to encourage movement and good sitting posture.

The present invention features a chair having a contoured seat cushion mounted on top of an exercise ball with four tension-adjustable elastic cords. The ball sits on top of a swivel plate, so that dynamic motion and counterbalancing are attainable for a variety of ergonomically beneficial seating styles. The contoured seat offers better weight distribution than sitting directly on the exercise ball directly. The dynamic relationship between the surface of the ball and the surfaces of the cushion above, and platform below, encourage core strengthening, continual spinal repositioning, enhanced blood flow by engaging the different muscles of the feet and ankles, legs, gluteal region, abdomen and back. The elastic cords, in addition to holding the seat cushion in a counter-tensioned balance on the ball through a dynamic range of postures and movement, also provide positive resistance for the muscles of the sitter to push against. The cushion swivels, slides front to back, rocks side to side, all within a limited range, adjustable by the user through innovative elastic locking mechanisms, as well as the relative inflation or deflation of the ball. The chair is height adjustable by inflating or deflating the exercise ball. The ball is centered on the lower platform by means of an upper and lower fastener, attached to an outer ball cover which serves both a decorative and protective function, lengthening the life and performance of the exercise ball. The chair has an optional lumbar support, fixed on an articulated back mechanism, so that the support can be directed specifically where the individual needs the support. Further the lumbar cushion is also dynamic, through a series of large spring coils tensioned between the outer cushion of the seat back and the inner plate, to create further resistance and encourage motion even when the lumbar back support is engaged.

DETAILED DESCRIPTION

Figure 1:
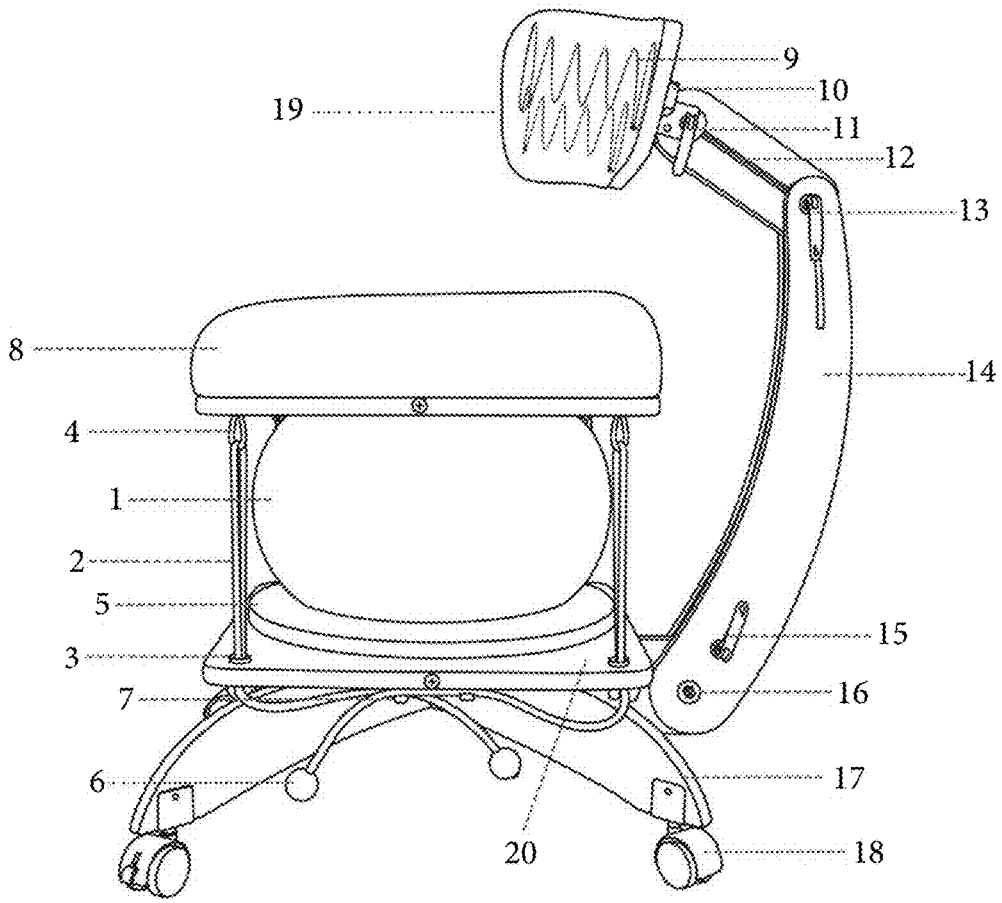
FIG. 1 provides a perspective view of an embodiment of the present invention.
Figure 4:
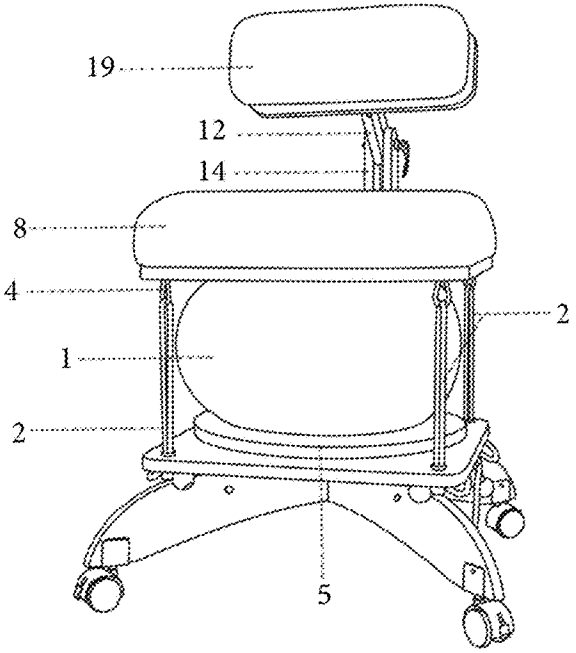
FIG. 4 provides a perspective view of another embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

The present invention features a chair having a contoured seat cushion mounted on top of an exercise ball with four tension-adjustable elastic cords such as bungee cords. The shock cords attach to the underside of the seat cushion by looping through spring-eye carabiner type hooks, and passing through grooved locking tubes with v-channels for adjusting the bungee cord tension. The ball sits on top of a swivel plate, so that dynamic motion and counterbalancing are attainable for a variety of ergonomically beneficial seating styles.

The chair has an optional lumbar support, fixed on an articulated back mechanism, so that the support can be directed specifically where the individual needs the support. Further the lumbar cushion is also dynamic, through a series of large spring coils tensioned between the outer cushion of the seat back and the inner plate, to create further resistance and encourage motion even when the lumbar back support is engaged.

Turning to FIGS. 1-7, embodiments of the ergonomic chair of the present invention are provided. The chair has a base 20 which may include a flat platform, and legs 17 having casters 18 attached thereto for both design and stability. A swivel plate 5 may be rotatably attached to the base 20. Above the swivel plate 5 and base 20 is an inflatable bladder 1. The inflatable bladder is shown here as an exercise ball, but may take any shape, structure, and/or form in various embodiments. Further, in some embodiments, the bladder 1 may be surrounded, at least partially, by a cover. The cover may protect the bladder 1 and may facilitate connection of the bladder 1 to base 20, swivel plate 5, and/or seat 8. Primarily, the inflatable bladder 1 serves to provide cushioning and also to provide movement in multiple axes and directions of the seat 8. The seat 8 is attached to a top of the bladder 1 and is capable of movement in front-back, side-side, and rotational directions, as well as angular variations there between. In the embodiment shown, four elastic cords 2 extend between seat 8 and base 20. It should be understood that the number and arrangement of straps may vary without straying from the scope of this invention. An example of this seat 8 movement can be seen in FIG. 7, which shows a user 71 leaning forward on the seat 8, causing compression of bladder 1, shortening of front cords 2*a* and lengthening of rear cords 2*b*.

In the embodiment shown, cords 2 are each passed through a loop 4 depending from seat 8. However, the cords 2 may connect to the seat 8 in any manner without straying from the scope of this invention. These elastic cords 2 serve to hold the seat 8 in place and slightly compress bladder 1. A tension of these cords 2 can be adjustable in some embodiments to increase or decrease compression of the bladder 1 which allows more (tighten) or less (loosen) movement resistance provided by the bladder 1.

In the embodiment shown, the end of cords 2 comprises a ball 6 to provide easy gripping for adjustment purposes. A cord keeper 7 is positioned on the bottom of base 20 to hold ends of cords 2 in place. A channel 3 is formed in the base 20 to allow a cord 2 to pass through. The channel 3, in some embodiments, may contain a clamp or other structure to hold the cord 2 in place to maintain a set level of tension once adjusted.

A back support extends from a rear of base 20. The back support may be any structure configured to support a back of a user. In the embodiment shown, the back support includes an elongate riser 14 pivotally attached to the base 20 via hinge 16. A locking clamp 15 allows angular adjustment of the riser 14 with respect to the base 20. A pivot arm 12 extends from a top of riser 14. The pivot arm 12 is both angularly adjustable with respect to riser 14, and also its position along a length of the riser 14 can be adjusted by a channel in both riser 14 and pivot arm 12. A clamp 13 holds the pivot arm 12 in place when in a closed position, and allows the pivot arm 12 to move when in an open position. A cushioned back support 19 is positioned above and over or behind the seat 8. The back support 19 may include springs 9 in some embodiments. In other cases, it may be padded, or may be formed of a single material. The back support 19 is attached to pivot arm 12 by connector 10, and is rotationally adjustable with respect to the pivot arm 12.

Figure 3:
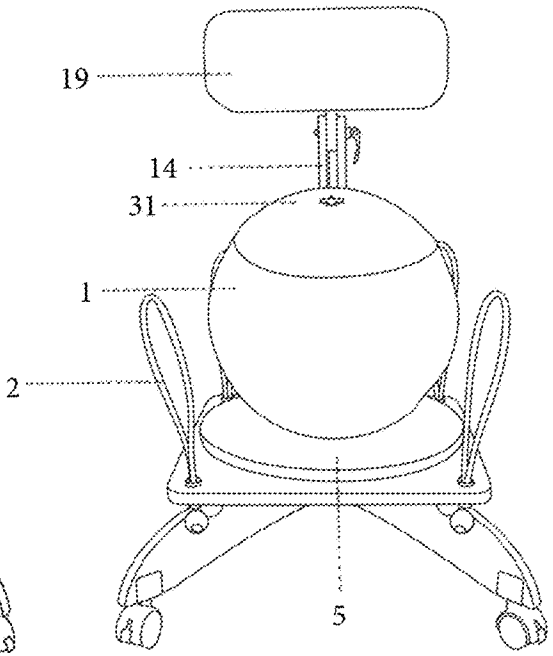
FIG. 3 provides a front view of yet another embodiment of the present invention.
Figure 2:
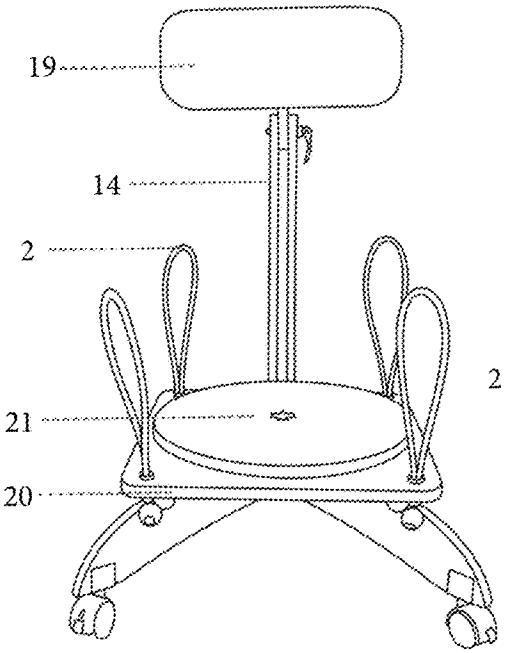
FIG. 2 provides a front view of an embodiment of the present invention showing the base structure.

FIG. 2 provides a detail view of the base 20 and swivel plate 5 having the bladder 1 removed. A connector slot 21 allows bladder 1 to connect to the swivel plate 5. FIG. 3 provides a detail view of the present invention having the seat 8 removed. A top of the bladder 1 includes a cover 31. The cover 31 has a connector slot that allows connection to seat 8.

Figure 5:
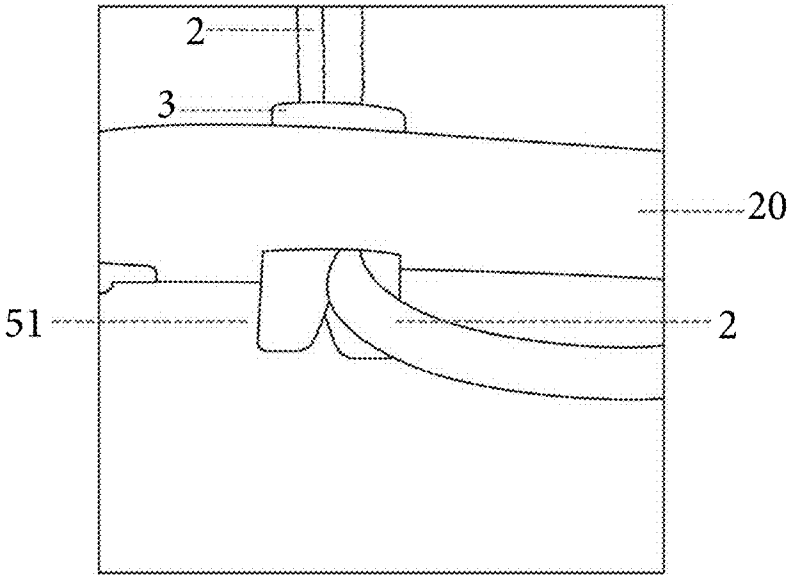
FIG. 5 provides a detail view of an embodiment of a securing structure for the elastic cords of the present invention.
Figure 7:
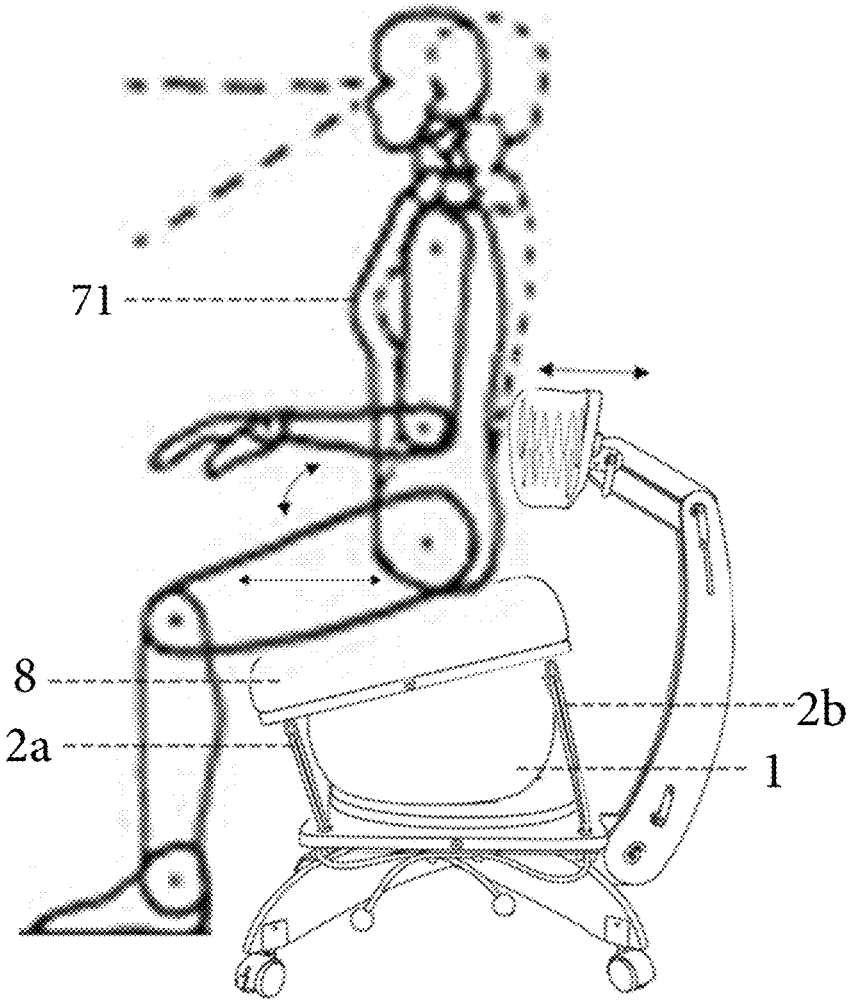
FIG. 7 provides a side view of another embodiment of the present invention having a user sitting thereon.

FIG. 5 provides a detail view of an embodiment of a cord clamp of the present invention. In this view, cord 2 passes through opening 3 in base 20. A V-clamp 51 serves to lock cord 2 in place when cord 2 is pinched by the narrow side of the V. If cord 2 is pulled to a central area of the V-clamp 51, it can move upwards and downwards to adjust tension of the cord 2.

Figure 6:
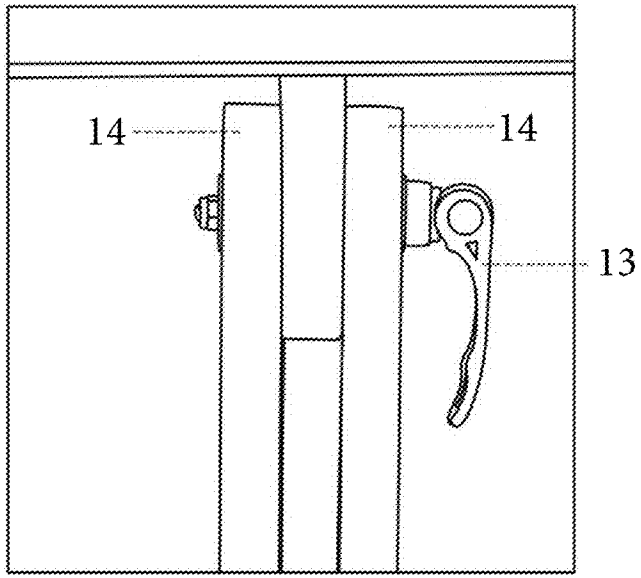
FIG. 6 provides a detail view of an embodiment of a cam locking structure that allows adjustment of various components of the back support.

FIG. 6 provides a detail view of the locking structure between riser and pivot arm. The riser 14 has a separated channel with pivot arm 12 there between. Clamp 13 is movable between an open position which lessens a pressure of the two portions of riser 14 on the outer side surfaces of pivot arm 12; and a closed position which increases the pressure of the two portions of riser to prevent a movement of pivot arm 12.

In operation, the contoured seat offers better weight distribution than sitting directly on the exercise ball directly. The dynamic relationship between the surface of the ball and the surfaces of the cushion above, and platform below, encourage core strengthening, continual spinal repositioning, enhanced blood flow by engaging the different muscles of the feet and ankles, legs, gluteal region, abdomen and back. The elastic cords, in addition to holding the seat cushion in a counter-tensioned balance on the ball through a dynamic range of postures and movement, also provide positive resistance for the muscles of the sitter to push against. The cushion swivels, slides front to back, rocks side to side, all within a limited range, adjustable by the user through innovative elastic locking mechanisms, as well as the relative inflation or deflation of the ball.

The chair is height adjustable by inflating or deflating the exercise ball. The ball is centered on the lower platform by means of an upper and lower fastener, attached to an outer ball cover which serves both a decorative and protective function, lengthening the life and performance of the exercise ball. The chair has an optional lumbar support, fixed on an articulated back mechanism, so that the support can be directed specifically where the individual needs the support. Further the lumbar cushion is also dynamic, through a series of large spring coils tensioned between the outer cushion of the seat back and the inner plate, to create further resistance and encourage motion even when the lumbar back support is engaged.

In varying embodiments, the chair may be used with or without the back support, with or without the seat cushion, and with or without the legs. The basic counter-tensioned ball assembly, can be used as a balancing platform for physical or occupational therapy training, for learning surfing or skateboarding, to help develop leg and balance motility and strength and aid in proprioceptive disorders.

As described, the chair platform can be used for strength and balance training, physical therapy, occupational therapy, or developing the skills for surfing, skateboarding, or other balance related skills.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A chair comprising:

a base;

a flexible bladder inflated with a gas positioned above the base and supported by the base;

a seat attached to a top of the flexible bladder;

a plurality of elastic cords extending between the seat and the base, the plurality of elastic cords compressing the flexible bladder, each of the plurality of elastic cords held under tension by the flexible bladder to a position above the seat; and an adjustable back support extending from the base.

2. The chair of claim 1 further wherein the plurality of elastic cords comprises four elastic cords, one of the four elastic cords positioned at each one of four corners of the base.

3. The chair of claim 1 wherein the back support further comprises:

a riser extending from the base above the seat, the riser pivotally attached to the base allowing angular adjustment of the riser relative to the base;

a pivot arm extending from the riser and extending towards the seat, an angle of the pivot arm relative to the riser being adjustable; and a pad connected to the pivot arm.

4. The chair of claim 3 wherein a position of the pivot arm is adjustable along a portion of a length of the riser, and wherein the pad is pivotally connected to the pivot arm such that an angle of the pad relative to the pivot arm is adjustable.

5. The chair of claim 1 further comprising a plurality of casters attached to a bottom of the base.

6. The chair of claim 1 further comprising a swivel plate positioned between the base and the flexible bladder, the swivel plate configured to rotate with respect to the base, and allowing the flexible bladder to rotate with respect to the base.

7. The chair of claim 1 wherein each of the plurality of elastic cords is adjustably attached to the base.

8. The chair of claim 7 wherein the base comprises a V-clamp, one of the plurality of elastic cords passing through the V-clamp, wherein the V-clamp is configured to allow the one of the plurality of elastic cords to be drawn through the V-clamp in a tightening direction, and is configured to prevent a reverse movement of the one of the plurality of elastic cords.

9. The chair of claim 1 further comprising a cover positioned over a surface of the flexible bladder.

10. The chair of claim 1 wherein the bladder is an exercise ball inflated with air.

11. A chair comprising:

a base;

a flexible bladder inflated with a gas positioned above the base;

a swivel plate positioned between the base and the flexible bladder, the flexible bladder attached to the swivel plate, the swivel plate configured to rotate with respect to the base, and allowing the flexible bladder to rotate with respect to the base;

a seat attached to a top of the flexible bladder;

a plurality of elastic cords extending between the seat and the base, the plurality of elastic cords compressing the flexible bladder, each of the plurality of elastic cords held under tension by the flexible bladder;

an adjustable back support extending from the base to a position above the seat.

12. The chair of claim 11 wherein the adjustable back support comprises a pad having internal springs.

13. The chair of claim 11 wherein the back support further comprises:

a riser extending from the base above the seat, the riser pivotally attached to the base allowing angular adjustment of the riser relative to the base;

a pivot arm extending from the riser and extending towards the seat, an angle of the pivot arm relative to the riser being adjustable; and a pad connected to the pivot arm.

14. The chair of claim 13 wherein a position of the pivot arm is adjustable along a portion of a length of the riser, and wherein the pad is pivotally connected to the pivot arm such that an angle of the pad relative to the pivot arm is adjustable.

15. The chair of claim 11 further comprising a plurality of casters attached to a bottom of the base.

16. The chair of claim 11 wherein each of the plurality of elastic cords is adjustably attached to the base.

17. The chair of claim 16 wherein the base comprises a V-clamp, one of the plurality of elastic cords passing through the V-clamp, wherein the V-clamp is configured to allow the one of the plurality of elastic cords to be drawn through the V-clamp in a tightening direction, and is configured to prevent a reverse movement of the one of the plurality of elastic cords.

18. The chair of claim 11 further comprising a cover positioned over a surface of the flexible bladder.

19. A chair comprising:

a base;

a flexible bladder inflated with a gas positioned above the base and supported by the base;

a seat attached to a top of the flexible bladder; and a plurality of elastic cords extending between the seat and the base, the plurality of elastic cords compressing the flexible bladder, each of the plurality of elastic cords held under tension by the flexible bladder to a position above the seat; and a swivel plate positioned between the base and the flexible bladder, the swivel plate configured to rotate with respect to the base, and allowing the flexible bladder to rotate with respect to the base.

* * * * *